US009694593B2

(12) United States Patent
Kuribayashi

(10) Patent No.: US 9,694,593 B2
(45) Date of Patent: Jul. 4, 2017

(54) LIQUID DISCHARGE APPARATUS HAVING A PRESSURE REGULATOR

(71) Applicant: TOSHIBA TEC KABUSHIKI KAISHA, Tokyo (JP)

(72) Inventor: Yasushi Kuribayashi, Mishima Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/844,388

(22) Filed: Sep. 3, 2015

(65) Prior Publication Data

US 2016/0067982 A1 Mar. 10, 2016

(30) Foreign Application Priority Data

Sep. 4, 2014 (JP) ..... 2014-180544

(51) Int. Cl.
*B41J 2/175* (2006.01)
*B41J 29/38* (2006.01)
*B41J 2/14* (2006.01)

(52) U.S. Cl.
CPC ..... *B41J 2/17596* (2013.01); *B41J 2/14233* (2013.01); *B41J 2/175* (2013.01); *B41J 2/17509* (2013.01); *B41J 2/17553* (2013.01); *B41J 2/17566* (2013.01); *B41J 29/38* (2013.01); *B41J 2202/12* (2013.01)

(58) Field of Classification Search
CPC ..... B41J 2/17596; B41J 2/175; B41J 2/18; F04B 5/00; F04B 3/00; F04B 1/124
See application file for complete search history.

(56) References Cited

U.S. PATENT DOCUMENTS 3,728,047 A * 4/1973 Mangialardi ..... F04B 3/00 417/488
4,343,596 A * 8/1982 Shimazawa ..... B41J 2/17596 417/252
4,541,450 A * 9/1985 Bron ..... A01C 23/042 137/101.31
5,619,232 A * 4/1997 Maeno ..... B41J 2/16508 347/30

(Continued)

FOREIGN PATENT DOCUMENTS

JP 2009160807 A 7/2009

*Primary Examiner* — Stephen Meier
*Assistant Examiner* — John P Zimmermann
(74) *Attorney, Agent, or Firm* — Patterson & Sheridan, LLP

(57) ABSTRACT

A liquid discharge apparatus includes a head, a recovery tank, a supply tank connected to the recovery tank, and a pressure regulator. The pressure regulator includes a first cylinder connected to an upper portion of the recovery tank, a first piston movable in the first cylinder, a first valve configured to open and close a path between the recovery tank and the first cylinder, depending on a position of the first piston, a second cylinder connected to the first cylinder and an upper portion of the supply tank, a second piston movable in the second cylinder, a second valve configured to open and close a path between the supply tank and the second cylinder, depending on a position of the second piston, and a third valve configured to open and close a path between the second cylinder and an atmosphere, depending on a position of the second piston.

20 Claims, 12 Drawing Sheets

(56) References Cited

U.S. PATENT DOCUMENTS

| | | | | |
|---|---|---|---|---|
| 5,961,258 | A * | 10/1999 | Ende | B21J 15/10 408/100 |
| 6,231,310 | B1 * | 5/2001 | Tojo | F04B 35/045 417/417 |
| 6,295,914 | B1 * | 10/2001 | Iversen | F15B 3/00 417/403 |
| 6,948,803 | B2 * | 9/2005 | Yoshida | B41J 2/175 347/85 |
| 8,636,346 | B2 * | 1/2014 | Borra | B41J 2/175 347/84 |
| 2001/0020970 | A1 * | 9/2001 | Kuribayashi | B41J 2/175 347/85 |
| 2005/0024397 | A1 * | 2/2005 | Mizoguchi | B41J 2/17509 347/7 |
| 2006/0132554 | A1 * | 6/2006 | Ota | B41J 2/17556 347/85 |
| 2009/0174735 | A1 | 7/2009 | Yamada | |
| 2011/0002802 | A1 * | 1/2011 | Capone | F04B 7/00 417/486 |
| 2012/0034119 | A1 * | 2/2012 | Du | F04B 3/00 417/523 |
| 2013/0194361 | A1 * | 8/2013 | Takahashi | B41J 2/19 347/92 |

* cited by examiner

LIQUID DISCHARGE APPARATUS HAVING A PRESSURE REGULATOR

CROSS-REFERENCE TO RELATED APPLICATION

This application is based upon and claims the benefit of priority from Japanese Patent Application No. 2014-180544, filed Sep. 4, 2014, the entire contents of which are incorporated herein by reference.

FIELD

Embodiments described herein relate generally to a liquid discharge apparatus, in particular, a liquid discharge apparatus having a pressure regulator.

BACKGROUND

A liquid discharge apparatus of one type circulates liquid, such as ink, through a head and a tank. The liquid is circulated through a flow channel including a pressure chamber corresponding to nozzles, and the liquid is discharged from the nozzles of the head. More specifically, the liquid is supplied from the tank to the head, and liquid that is not discharged from the nozzles is returned to the tank.

In such a liquid discharge apparatus, in order to circulate the liquid stably, the pressure on the liquid is controlled. A mechanism for controlling the pressure may be, for example, a bellows connected to the tank and operating the bellows such that the volume in the bellows changes due to the expansion and contraction thereof. However, many actuators are required to operate the bellows, and a certain clearance surrounding the bellows is required for the bellows to be operated. Therefore, it is difficult to manufacture a compact liquid discharge apparatus.

DETAILED DESCRIPTION

Figure 1:
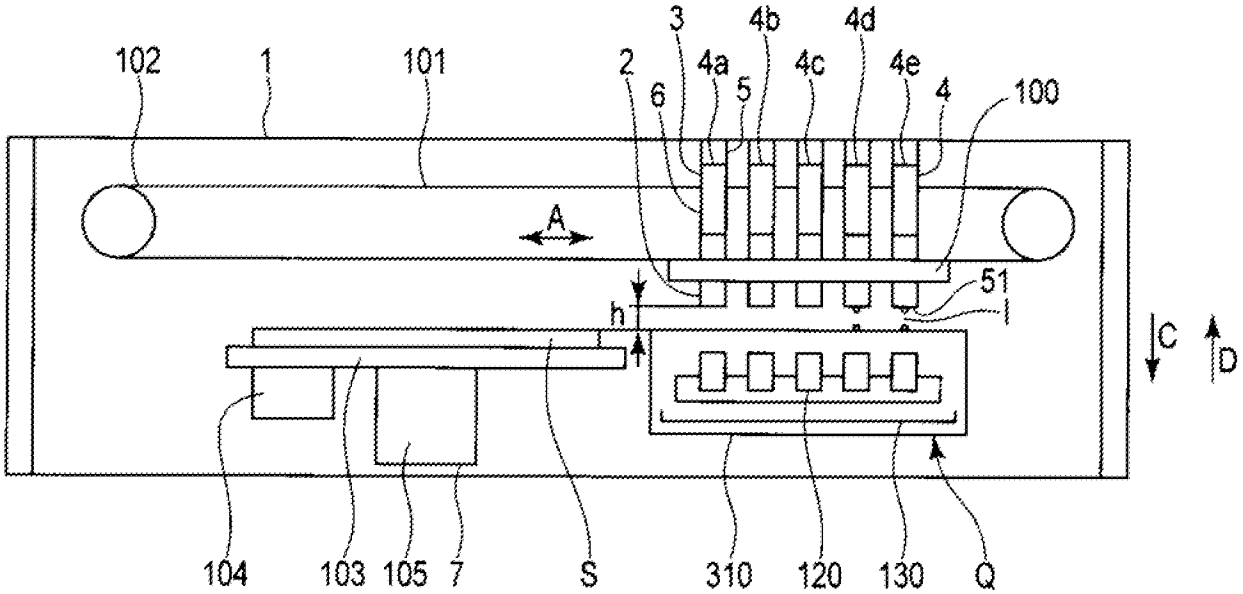
FIG. 1 is a side view of an ink jet apparatus according to a first embodiment.

In general, according to an embodiment, a liquid discharge apparatus includes a head including a one or more nozzles, a first tank to which liquid from the head is recovered (returned), a second tank that is connected to the first tank and from which liquid is supplied to the head, and a pressure regulator. The pressure regulator is configured to adjust a pressure on the liquid and includes a first cylinder connected to an upper portion of the first tank, a first piston movable in the first cylinder, a first valve configured to open and close a path between the first tank and the first cylinder according to position of the first piston, a second cylinder connected to the first cylinder and an upper portion of the second tank, a second piston movable in the second cylinder, a second valve configured to open and close a path between the second tank and the second cylinder according to position of the second piston, and a third valve configured to open and close a path between the second cylinder and an atmosphere according to position of the second piston.

In another embodiment, a liquid discharge apparatus includes a liquid discharge head that includes a pressure chamber that communicates with a nozzle for discharging a liquid, a liquid supply port that communicates with upstream of the pressure chamber, and a liquid discharge port that communicates with downstream of the pressure chamber; a first air chamber that contains air coming in contact with a liquid discharged from the liquid discharge port; a second air chamber that contains air coming in contact with a liquid supplied to the liquid supply port; a third air chamber that is communicable with the first air chamber; a first opening and closing member that switches a communication state between the first air chamber and the third air chamber; a fourth air chamber that is communicably connected to the second air chamber and communicates with the third air chamber; a second opening and closing member that switches a communication state between the second air chamber and the fourth air chamber; a third opening and closing member that opens and closes the fourth air chamber with respect to atmosphere; and a first volume adjustable portion that changes a volume of the fourth air chamber.

First Embodiment

Hereinafter, an ink jet apparatus 1 according to a first embodiment will be described with reference to FIG. 1 to FIG. 11. For illustration in the drawings, configurations are illustrated to be appropriately expanded, reduced, or omitted. Note that, the same or equivalent components are denoted by the same reference numerals.

Figure 2:
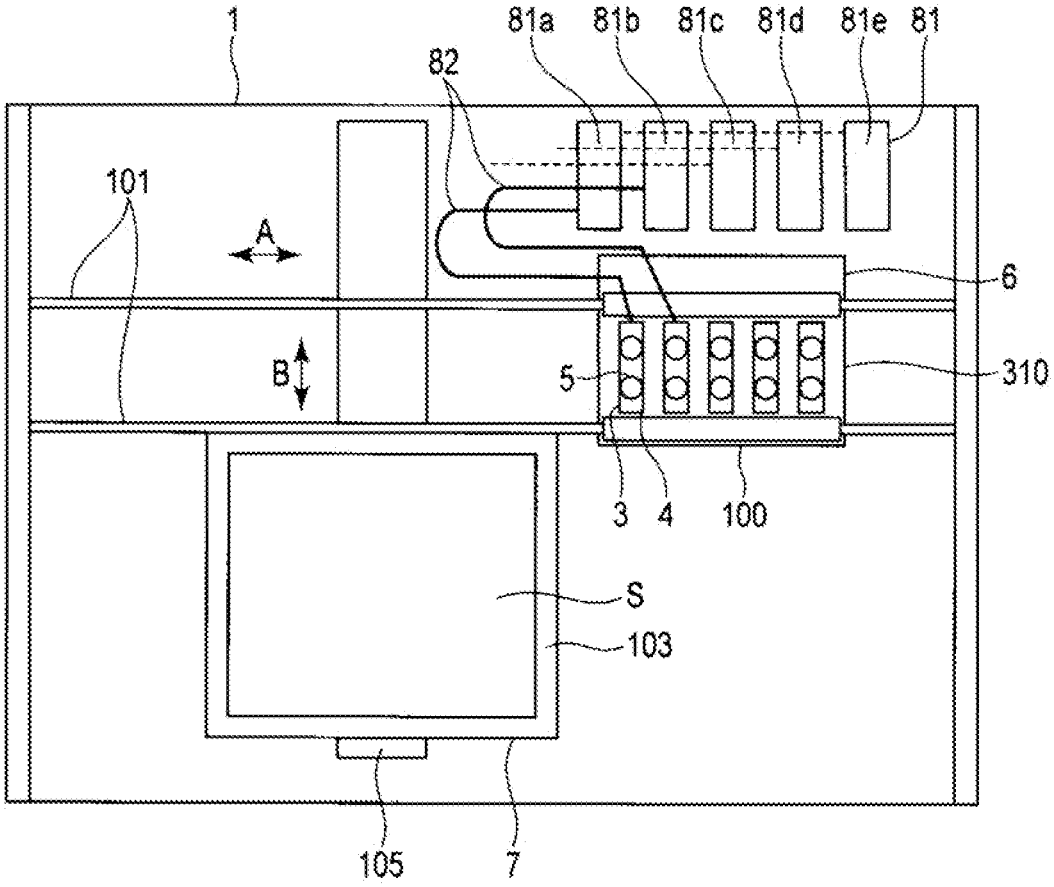
FIG. 2 is a top view of the ink jet apparatus.

FIG. 1 is a side view of an inkjet apparatus 1, and FIG. 2 is a top view of the ink jet apparatus 1. As illustrated in FIG. 1 and FIG. 2, the ink jet apparatus 1, which is a liquid discharge apparatus, includes an image forming unit 6, a medium moving unit 7 which is a transporting unit, and a maintenance unit 310.

The image forming unit 6 includes an ink jet unit 4, a carriage 100 which supports the ink jet unit 4, a transport belt 101 which causes the carriage 100 to reciprocate in directions of an arrow A, and a carriage motor 102 which drives the transport belt 101.

The ink jet unit 4 includes an ink jet head 2, which is a liquid discharge unit, an ink circulation device 3, which is a circulation unit, and a pressure regulator 5.

The ink circulation device 3 is positioned above the ink jet head 2, and is integrally formed with the ink jet head 2. The ink jet unit 4 discharges ink to a medium S to form a desired image.

The ink jet unit 4 includes, for example, ink jet units 4*a*, 4*b*, 4*c*, 4*d*, and 4*e* which are respectively discharge cyan ink, magenta ink, yellow ink, black ink, and white ink. Use of ink colors or characteristics of the respective ink jet units 4*a*, 4*b*, 4*c*, 4*d*, and 4*e* are not limited. For example, the ink jet unit 4*e* may discharge transparent glossy ink, or ink that has a color when irradiated with an infrared ray or an ultraviolet ray, instead of the white color. Each of the ink jet units 4*a*, 4*b*, 4*c*, 4*d*, and 4*e* uses different ink, but has the same configuration. Therefore, the description will be made using the same reference numerals.

Since the ink circulation device 3 is provided above the ink jet head 2, the width of the ink jet unit 4 is reduced. Accordingly, it is possible to reduce the width of the carriage 100 which supports a plurality of ink jet units 4*a* to 4*e* in parallel. The image forming unit 6 may reduce a transport distance of the carriage 100 by reducing the width of the carriage 100, whereby the miniaturization of the ink jet apparatus 1 may be achieved and a printing speed may be improved.

The image forming unit 6 includes an ink cartridge 81 for supplying new ink to the ink circulation device 3. The ink cartridge 81 includes ink cartridges 81*a*, 81*b*, 81*c*, 81*d*, and 81*e* which contain cyan ink, magenta ink, yellow ink, black ink, and white ink, respectively. Each of the ink cartridges 81*a*, 81*b*, 81*c*, 81*d*, and 81*e* contains different ink, but has the same configuration. Therefore, the description will be made with using the same reference numerals. The ink cartridge 81 is connected to the ink circulation device 3 of the inkjet unit 4 via a tube 82. The ink cartridge 81 is arranged on the lower side relative to the ink circulation device 3 in a gravitational direction.

The medium moving unit 7 includes a table 103 for suctioning and fixing the medium S. The table 103 is attached onto a slide rail device 105 and reciprocates in directions of an arrow B. The inside of the table 103 is caused to have a negative pressure by the pump 104 and then the medium S is suctioned via small-diameter holes and fixed on an upper surface of the table 103. A distance h between a nozzle plate 52 and the medium S of the ink jet head 2 is maintained to be constant while the ink jet unit 4 reciprocates along the transport belt 101 in the directions of the arrow A. The ink jet head 2 includes nozzles 51 which are 300 liquid discharge portions in the longitudinal direction of the nozzle plate 52. The longitudinal direction of the nozzle plate 52 is the same as the transport direction of the medium S.

The image forming unit 6 forms an image on the medium S while the ink jet head 2 reciprocates in the directions orthogonal to the transport direction of the medium S. The ink jet head 2 forms the image on the medium S by discharging the ink I from nozzles 51 provided on the nozzle plate 52 in response to an image forming signal. The ink jet unit 4 forms the image on the medium S, for example, in the width corresponding to the 300 nozzles 51.

The maintenance unit 310 is a scanning range of the ink jet unit 4 in the directions of the arrow A, and is arranged at a position outside a moving range of the table 103. The ink jet head 2 faces the maintenance unit 310 in a standby position Q. The maintenance unit 310 is a case of which upper side is open, and is configured to move in the vertical direction (directions of arrows C and D in FIG. 1).

When the carriage 100 for printing an image moves in a direction of the arrow A, the maintenance unit 310 is separated from the nozzle plate 52 by moving downward (a direction of the arrow C). When a printing operation is completed, the maintenance unit 310 moves upward (the direction of the arrow D). When the printing operation is completed and then the ink jet head 2 returns to the standby position Q, the maintenance unit 310 moves upward, and covers the nozzle plate 52 of the ink jet head 2. The maintenance unit 310 prevents the ink on the nozzle plate 52 from being evaporated, and prevents dust or paper powder from being attached to the nozzle plate 52. The maintenance unit 310 has a cap function for the nozzle plate 52.

The maintenance unit 310 includes a rubber blade 120 and a waste ink receiving unit 130. The rubber blade 120 removes ink, dust, paper powder, or the like which is attached to the nozzle plate 52 of the inkjet head 2. The waste ink receiving unit 130 receives waste ink, dust, paper powder, or the like which is generated during a maintenance operation. The maintenance unit 310 has a mechanism for moving the blade 120 in the direction of the arrow B, and wipes the surface of the nozzle plate 52 using the blade 120.

In order to remove the deteriorated ink in the vicinity of the nozzle, the ink jet head 2 performs the maintenance (a spitting function) for forcibly discharging the ink from the nozzle 51. The ink jet head 2 performs the maintenance (a purge function) for causing the ink to slightly flow out from the nozzle 51, taking the paper powder or the dust which is attached on the surface of the ink jet head 2 into the film of the flowed ink, and then wiping the surface using the blade 120. The waste ink receiving unit 130 recovers the waste ink generated due to the spitting function or the purge function.

The ink jet apparatus 1 is a so-called serial type ink jet apparatus which forms an image on a medium S by discharging ink from the nozzles 51 while the ink jet head 2 reciprocates in the directions orthogonal to the direction in which the medium S is transported by the medium moving unit 7.

Figure 6:
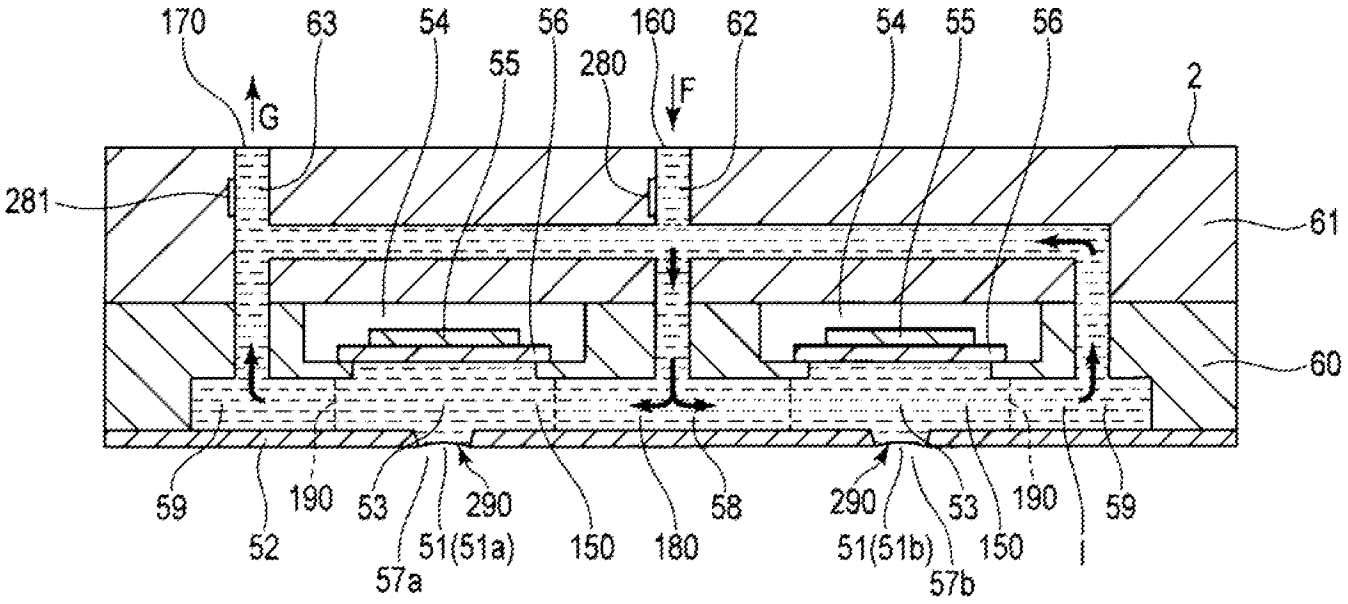
FIG. 6 is a cross-sectional diagram of an ink jet head in the ink jet apparatus according to the first embodiment.
Figure 7:
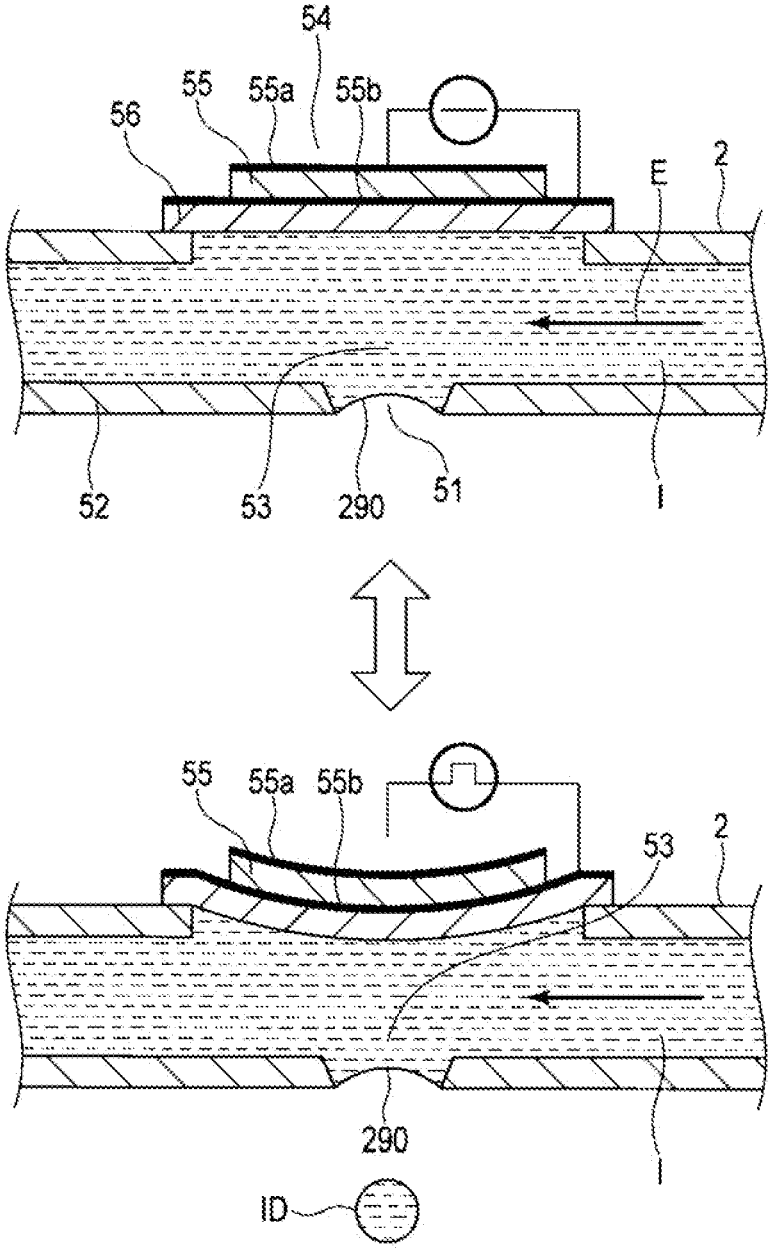
FIG. 7 schematically illustrates discharge of ink from the ink jet head.

The ink jet head 2 includes, as illustrated in FIG. 6 and FIG. 7, the nozzle plate 52 including the nozzles 51, a substrate 60 including a plurality of actuators 54, and a manifold 61 attached to the substrate 60. The substrate 60 includes an ink channel 180 that guides the ink between the nozzle 51 and the actuator 54. Each of the actuators 54 faces the ink channel 180, and corresponds to one of the nozzles 51.

The substrate 60 includes a boundary wall 190 between the adjacent nozzles 51 in such a manner that the pressure applied to the ink in the ink channel 180 by the actuator 54 is focused on ink near the nozzle 51. A portion of the ink channel 180 which is surrounded by the nozzle plate 52, the actuator 54, and the boundary wall 190 forms an ink pressure chamber 150. Each of the ink pressure chambers 150 corresponds to one of the nozzles 51*a* in a first nozzle row 57*a*, or one of the nozzles 51*b* in a second nozzle row 57*b*. The first nozzle row 57*a* and the second nozzle row 57*b* respectively include 300 nozzles 51*a* and 300 nozzles 51*b*.

The substrate 60 includes a common ink supply chamber 58 to supply ink to the plurality of ink pressure chambers 150, and includes common ink chambers 59 to recover the ink from the plurality of ink pressure chambers 150 on the side of the second nozzle row 57*b* and the side of the first nozzle row 57*a*, respectively.

The manifold 61 includes an ink supply port 160, which is a liquid supply port to convey the ink I in a direction of an arrow F, and an ink discharge port 170, which is a liquid discharge port to convey the ink I in a direction of an arrow G. The ink I is supplied to the ink supply port 160 from the ink circulation device 3, and the ink flows back to ink circulation device 3 from the ink discharge port 170. The manifold 61 includes an ink distribution passage 62 that connects the common ink supply chamber 58 to the ink supply port 160. The manifold 61 includes an ink circulating passage 63 that connects the ink discharge port 170 to the common ink chambers 59.

That is, the ink channel 180 is formed in the substrate 60, the manifold 61, and the nozzle plate 52 of the ink jet head 2. The ink channel 180 includes the plurality of ink pressure chambers 150 which communicate with the nozzles 51*a* and 51*b*, an ink supply port 160*a* and an ink discharge port 170 which are formed in the manifold 61, the common ink supply chamber 58 which communicates with the plurality of ink pressure chambers 150, the common ink chambers 59 to recover the ink form the plurality of ink pressure chambers 150, the ink distribution passage 62 which connects the common ink supply chamber 58 and the ink supply port 160, and the ink discharge port 170 which connects the ink circulating passage 63 and the common ink chamber 59.

The ink I which flows in the ink distribution passage 62 in a direction of an arrow F flows into the plurality of ink pressure chambers 150 from the common ink supply chamber 58. An ink branch portion 53 is a portion in which the ink flowing in a direction of an arrow E is branched into ink which is discharged from the nozzle 51, and ink which flows through the ink jet head 2 and returns to the ink circulation device 3. A portion of the ink I flows into the ink pressure chamber 150 from an end portion thereof, and flows out from the other end portion thereof by passing through the ink branch unit 53. That is, some ink are discharged from the nozzle 51 in the ink pressure chamber 150 from the ink branch unit 53, and the remaining ink flows out of the other end portion. The ink I, which is not discharged from the nozzle 51 in the ink pressure chamber 150, flows into one of the common ink chambers 59 and flows towards the ink circulating passage 63.

The actuator 54 of the ink jet head 2 includes, for example, a unimorph-type piezoelectric vibration plate in which a piezoelectric element 55 and a vibration plate 56 are stacked. The piezoelectric element 55 is formed of a piezoelectric ceramic material such as lead zirconate titanate (PZT). The vibration plate 56 is formed of, for example, silicon nitride (SiN).

As illustrated in FIG. 7, the piezoelectric element 55 includes electrodes 55*a* and 55*b* on the upper side and the lower side thereof, respectively. As the piezoelectric element 55 is not deformed when a voltage is not applied to the electrodes 55*a* and 55*b*, the actuator 54 is not deformed. When the actuator 54 is not deformed, a meniscus 290 which is an interface between the ink I and the air is formed because of a surface tension of the ink I in the nozzle 51. The ink I in the ink pressure chamber 150 stays in the nozzle 51 because of the meniscus 290.

When a voltage (V) is applied to the electrodes 55*a* and 55*b*, the piezoelectric element 55 is deformed, and the actuator 54 is deformed. When the actuator 54 is deformed, the pressure applied to the meniscus 290 becomes greater than the air pressure (a positive pressure), and the ink I becomes an ink droplet ID by breaking through the meniscus 290 and is discharged from the nozzle 51.

The ink jet head causes pressure variation of the ink in the ink pressure chamber, and the structure thereof is not limited. The ink jet head may have, for example, a structure that discharges ink droplets by deforming the vibration plate using static electricity, or a structure that discharges ink droplets from the nozzle using heat energy from a heater or the like. In addition, since the ink viscosity is changed depending on the temperature and discharge characteristics from the nozzle are changed, the ink jet head may include a temperature sensor so as to preferably control the amount of the ink discharged.

An in-head temperature sensor (upstream) 280 for detecting the temperature of the ink supplied to the ink jet head 2 is attached to an ink distribution passage 62. Similarly, an in-head temperature sensor (downstream) 281 for detecting the temperature of the ink discharged from the ink jet head 2 is attached to an ink circulating passage 63. The in-head temperature sensors 280 and 281 detect the temperature of the ink which supplied to the ink jet head 2 or discharged from the ink jet head 2. The ink circulation device 3 is controlled in consideration of the ink viscosity changed in accordance with the temperature of the ink in the ink jet head 2.

The ink I flows, in the ink jet head 2, in order of the ink supply port 160, the ink distribution passage 62, the common ink supply chamber 58, the ink pressure chamber 150, the common ink chamber 59, the ink circulating passage 63, and the ink discharge port 170. Some of the ink I is discharged from the nozzles 51 in response to the image signal, and the remaining ink I flows back from the ink discharge port 170 to the ink circulation device 3.

Figure 3:
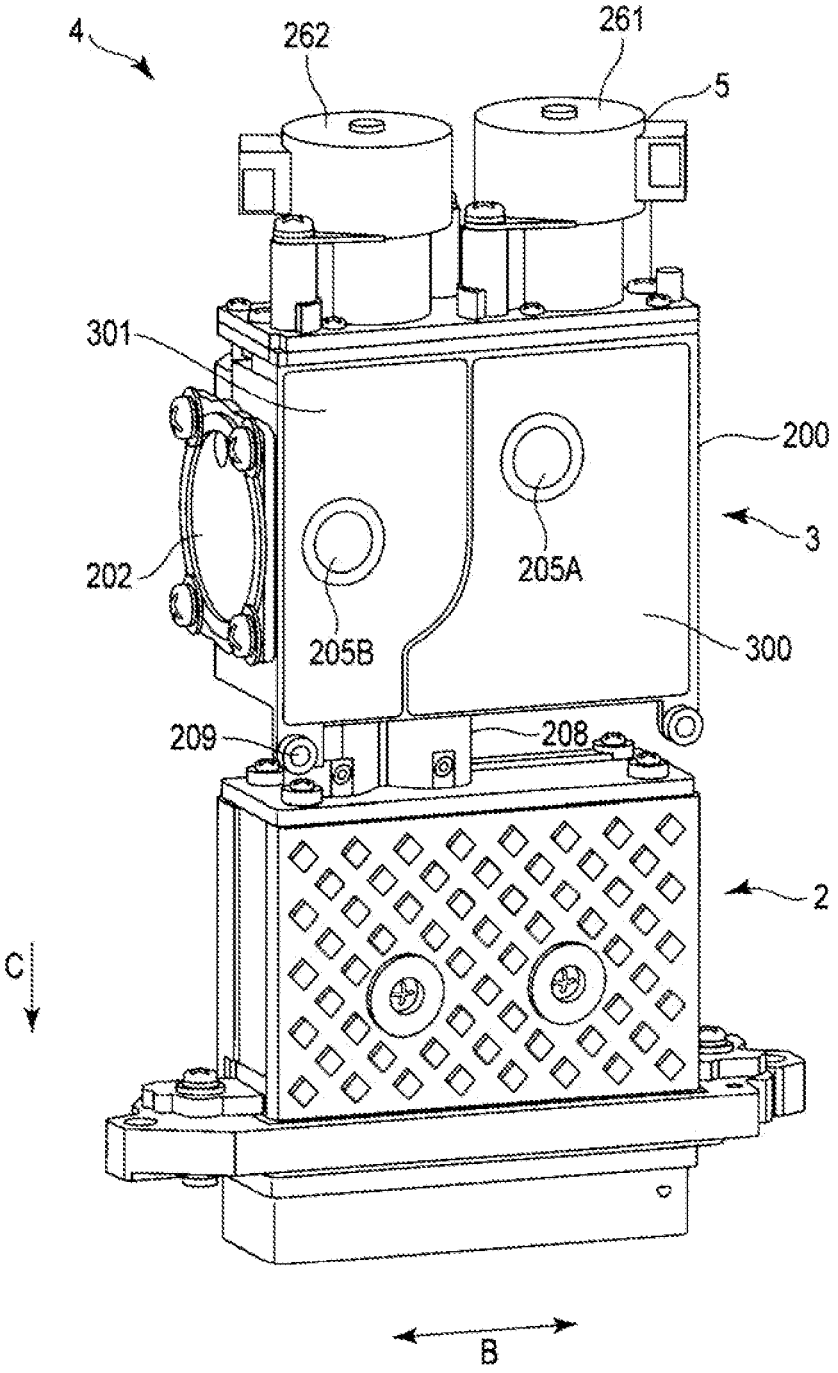
FIG. 3 is a perspective view of an ink jet unit in the ink jet apparatus according to the first embodiment.
Figure 4:
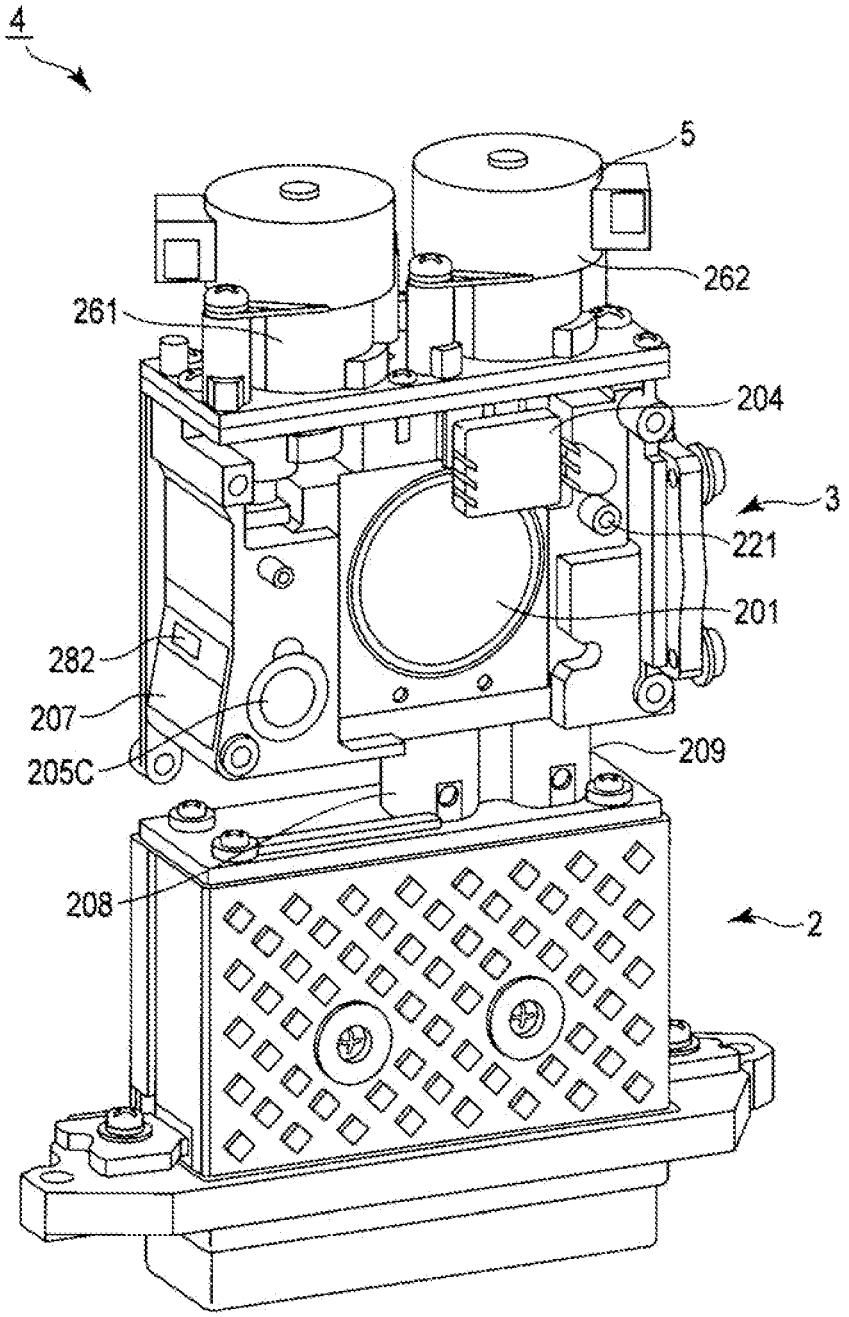
FIG. 4 is a perspective view of the ink jet unit from an angle different from an angle of FIG. 3.
Figure 5:
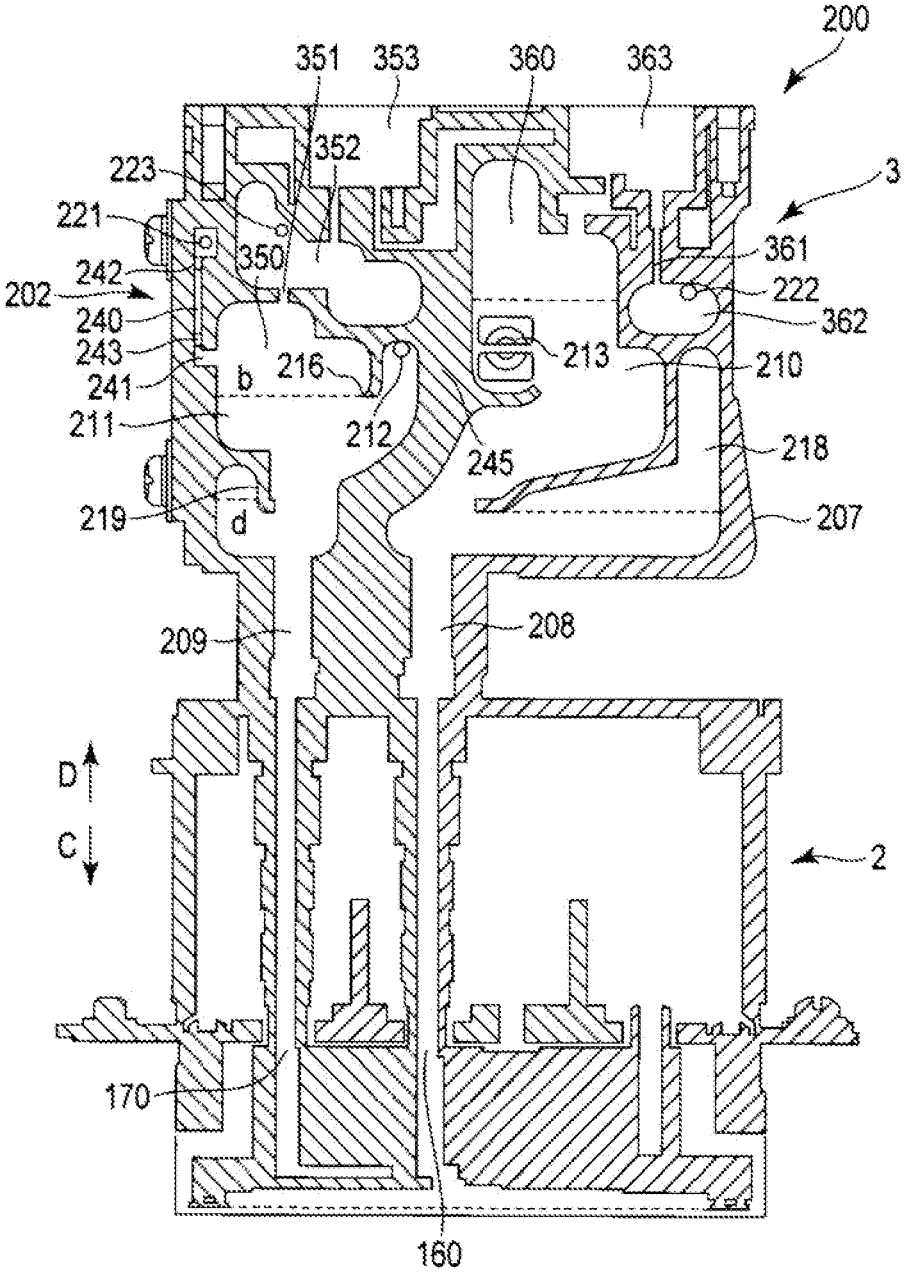
FIG. 5 is a cross-sectional diagram of the ink jet unit.

As illustrated in FIG. 3 to FIG. 5, the ink circulation device 3, includes an ink casing 200, an ink circulation pump 201 which circulates the ink, and an ink supply pump 202 which supplies the ink from the ink cartridge 81 to the ink casing 200.

The ink casing 200 is formed by fixing resin plates 300 and 301 which are formed of a polyimide resin onto a frame portion which is formed of aluminum, by an adhesive, such that air chambers are formed thereby. In the ink casing 200, an ink supplying chamber 210 which communicates with the ink jet head 2 via an ink supply pipe 208, and an ink recovering chamber 211 which communicates with the ink jet head 2 via an ink return pipe 209 are integrally formed to be adjacent to each other via a common wall 245. The ink casing 200 includes a suction hole 212 to suction the ink from the ink recovering chamber 211, and a discharge hole 213 to discharge the ink to the ink supplying chamber 210. Two recessed portions 353 and 363 are formed on an upper portion of the ink casing 200. The recessed portions 353 and 363 are engaged with a protrusion 372 and a protrusion 370 of the pressure regulator 5 illustrated in FIG. 9, respectively.

The ink recovering chamber 211 and the ink supplying chamber 210 are arranged in the same direction as the nozzle arrangement direction of the inkjet head 2 (the longitudinal direction (B direction) of the ink jet head 2). That is, the ink recovering chamber 211 and the ink supplying chamber 210 are arranged in a direction substantially orthogonal to the scanning direction of the carriage 100. A space above an ink liquid level b of the ink recovering chamber 211 is a first air chamber 350 of the pressure regulator 5. A space above an ink liquid level a of the ink supplying chamber 210 is a second air chamber 360 of the pressure regulator 5.

The ink circulation pump 201 is provided on the surface opposite to a first plate 300 and the second plate 301 as illustrated in FIG. 4, and along a path between the ink recovering chamber 211 and the ink supplying chamber 210, which are adjacent to each other. The ink circulation pump 201 suctions the ink from the suction hole 212, and the ink is supplied to the ink supplying chamber 210 through the discharge hole 213. The ink circulation pump 201 is the same piezoelectric pump as the ink supply pump 202, supplies the ink by periodically changing the volume in the pump (the pump chamber) with the bent piezoelectric vibration plate formed by bonding the piezoelectric element and the metal plate to each other, and causes the ink to be fed in one direction using two check valves. One check valve of the ink circulation pump 201 is provided between the suction hole 212 and a pump chamber, and the other check valve is provided between the pump chamber and the discharge hole 213. When the ink flows into the pump chamber, the one check valve is opened and the other check valve is closed. When the ink flows out from the pump chamber, the one check valve is closed and the other check valve is opened. The ink is conveyed from the ink recovering chamber to the ink supplying chamber by repeating the above operation.

The ink supply pump 202 is provided on an exterior wall of the ink casing 200. The supply pump 202 is the piezoelectric pump, and supplies the ink, in order to compensate ink consumed for the printing or the maintenance operation, from the ink supply port 221 to the ink recovering chamber 211 in the ink circulation device 3. A tube 82 for conveying the ink from the ink cartridge 81 to the ink circulation device 3 is connected to the ink supply port 221, which is an inflow port for allowing the ink to flow into the ink supply pump 202.

The ink supply pump 202 transports the ink by periodically changing the volume in the pump (a pump chamber 240) with the bent piezoelectric vibration plate formed by bonding the piezoelectric element and the metal plate to each other, and causes the ink to be transported in one direction using two check valves. One check valve 242 of the ink supply pump 202 is provided between the ink supply port 221 and the pump chamber 240, and the other check valve 243 is provided between the pump chamber 240 and an ink outlet 241. When the piezoelectric vibration plate is bent and the pump chamber 240 expands, the check valve 242 is opened, the ink flows into the pump chamber 240, and the check valve 243 is closed. When the piezoelectric vibration plate is bent in the reverse direction and the pump chamber 240 contracts, the check valve 242 is closed, the check valve 243 is opened, and thus the ink flows out from the pump chamber 240. The ink is fed by repeating the above operation.

Figure 11:
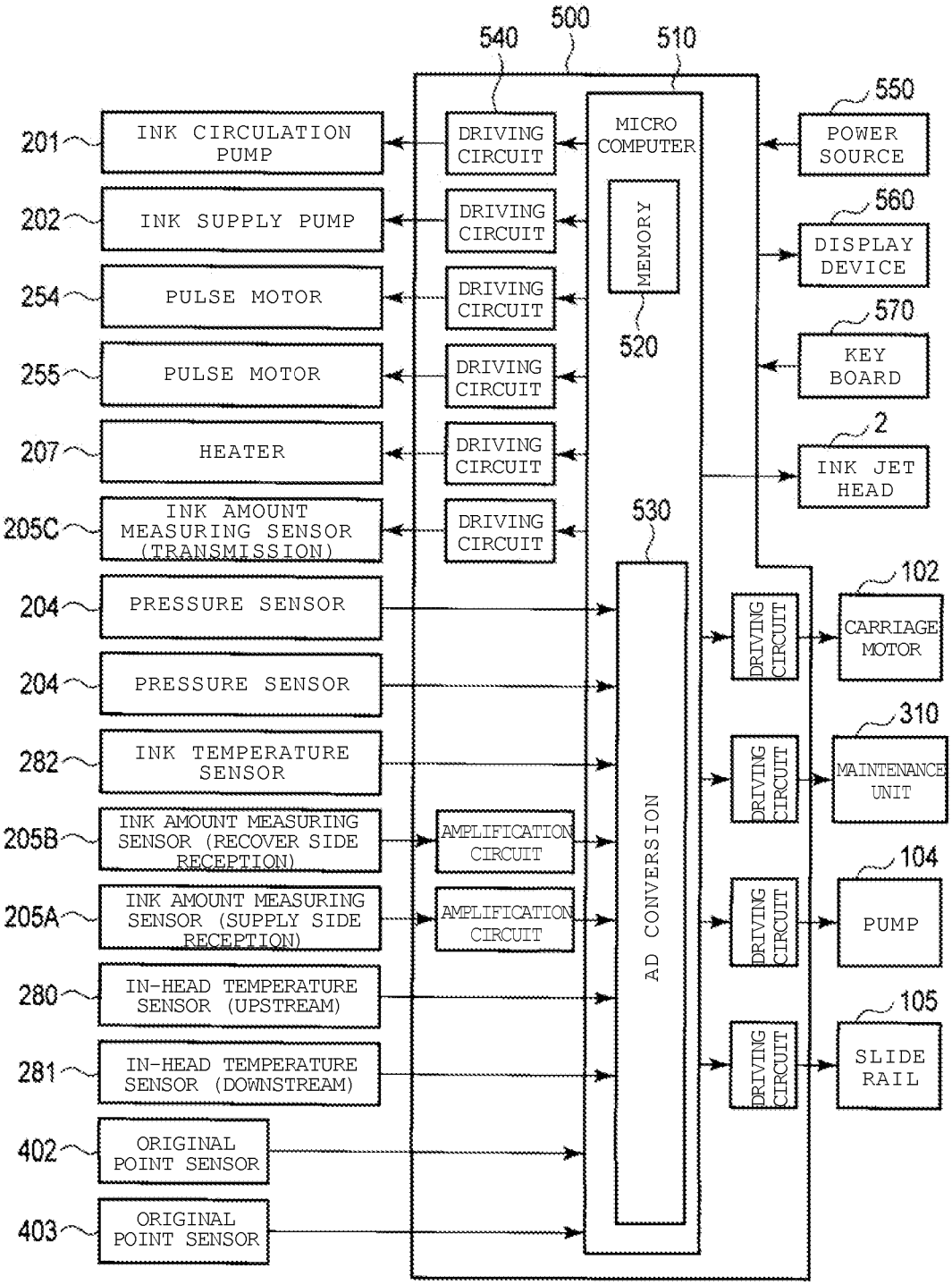
FIG. 11 is a block diagram illustrating a control relationship in the ink jet apparatus.

A control circuit board 500 is attached to the ink jet unit 4 so as to cover the ink circulation pump 201 (See FIG. 11). The control circuit board 500 controls the ink circulation pump 201, the ink supply pump 202, and the pressure regulator 5.

An ink amount measuring sensor 205A for measuring an amount of ink in the ink casing 200 is attached to the first plate 300. An ink amount measuring sensor 205B is attached to the second plate 301. An ink vibrator 205C has a piezoelectric vibration plate bonded to the ink casing 200, and the piezoelectric vibration plate is vibrated at an AC voltage so as to vibrate the ink in the ink casing 200. The vibration transmitted to the ink in the ink casing 200 by the ink vibrator 205C is detected by the ink amount measuring sensors 205A and 205B, and the ink amount is measured.

A heater 207 which heats the ink to adjust the ink viscosity in the ink casing 200 is provided outside the ink casing 200. The heater 207 is bonded to the ink casing 200 using an adhesive having high thermal conductivity. An ink temperature sensor 282 is attached to the vicinity of the heater 207. The ink temperature sensor 282 and the heater 207 are connected to the control circuit board 500, and the heater 207 is controlled to be a desired ink viscosity at the time of printing.

When the ink circulation pump 201 is operated, the ink is suctioned through the suction hole 212 from the ink recovering chamber 211 and is transported to the ink supplying chamber 210 through the ink circulation pump 201 and the discharge hole 213. The internal pressure of the sealed ink supplying chamber 210 becomes higher in accordance with an increase in the ink amount, and ink flows into the ink jet head 2 through the ink supply pipe 208.

The ink cartridge 81 that supplies ink to the ink recovering chamber 211 is arranged at a position lower than the ink circulation device 3 in the gravitational direction (the C direction). By arranging the ink cartridge 81 in this manner, a head pressure of the ink in the ink cartridge 81 is kept to be lower than a setting pressure of the ink recovering chamber 211. With such a configuration, the ink I is supplied to the ink recovering chamber 211 only when the ink supply pump 202 is operated.

The ink circulation device 3 supplies the ink I to the ink jet head 2, recovers the ink I which remains without being discharged from the nozzle 51, and circulates the ink by supplying the ink recovered to the ink jet head 2 again. The ink circulation device 3 feeds the ink downward (the arrow C in the gravitational direction) through the ink supply pipe 208, and the ink jet head 2 discharges the ink to further downward.

The meniscus 290 is formed in the nozzles 51 of the ink jet head 2. When ink is discharged from one of the nozzle 51, the ink becomes an ink droplet and discharged by breaking through the meniscus 290, which is the interface between the ink and the air. When the pressure applied to the meniscus 290 is greater than the air pressure (a positive pressure), the ink is discharged from the nozzle 51. When the pressure applied to the meniscus 290 is smaller than the air pressure (a negative pressure), the ink maintains the meniscus 290 and stored in the nozzle 51. For this reason, when the ink is not discharged, the pressure of the ink in the ink pressure chamber 150 is adjusted to be between −0.5 kPa and −4.0 kPa (a gauge pressure), and the meniscus 290 is maintained. Since the nozzle 51 is arranged in such a manner that the ink is discharged downward in the gravitational direction, when the pressure is greater (the positive pressure side) than the aforementioned range, the ink is discharged from the nozzle due to the slight vibration or the like. In addition, when the pressure is smaller (the negative pressure side) than the aforementioned range, the air is suctioned from the nozzle, and thus a discharge failure may occur. Normally, the inside of the ink pressure chamber 150 is kept to be the negative pressure, and when the actuator 54 is operated, the pressure inside the ink pressure chamber becomes the positive pressure, and the ink is discharged from the nozzle 51. Ink flow resistances from each of the ink supplying chamber 210 and the ink recovering chamber 211 to the nozzles 51 of the ink jet head 2 are substantially the same as each other. Since the ink flow resistances are substantially the same as each other, the pressure of the ink at the nozzles 51 is obtained by adding the average value of the pressure corresponding to a head difference between a nozzle surface and an ink surface of both ink chambers to an average value of the pressure in the second air chamber 360 and the pressure in the first air chamber 350. The pressure is adjusted in such a manner that the pressure of the ink at the nozzles 51 of the pressure regulator 5 becomes a predetermined pressure, and thereby the satisfactory ink discharge may be maintained.

Figure 8:
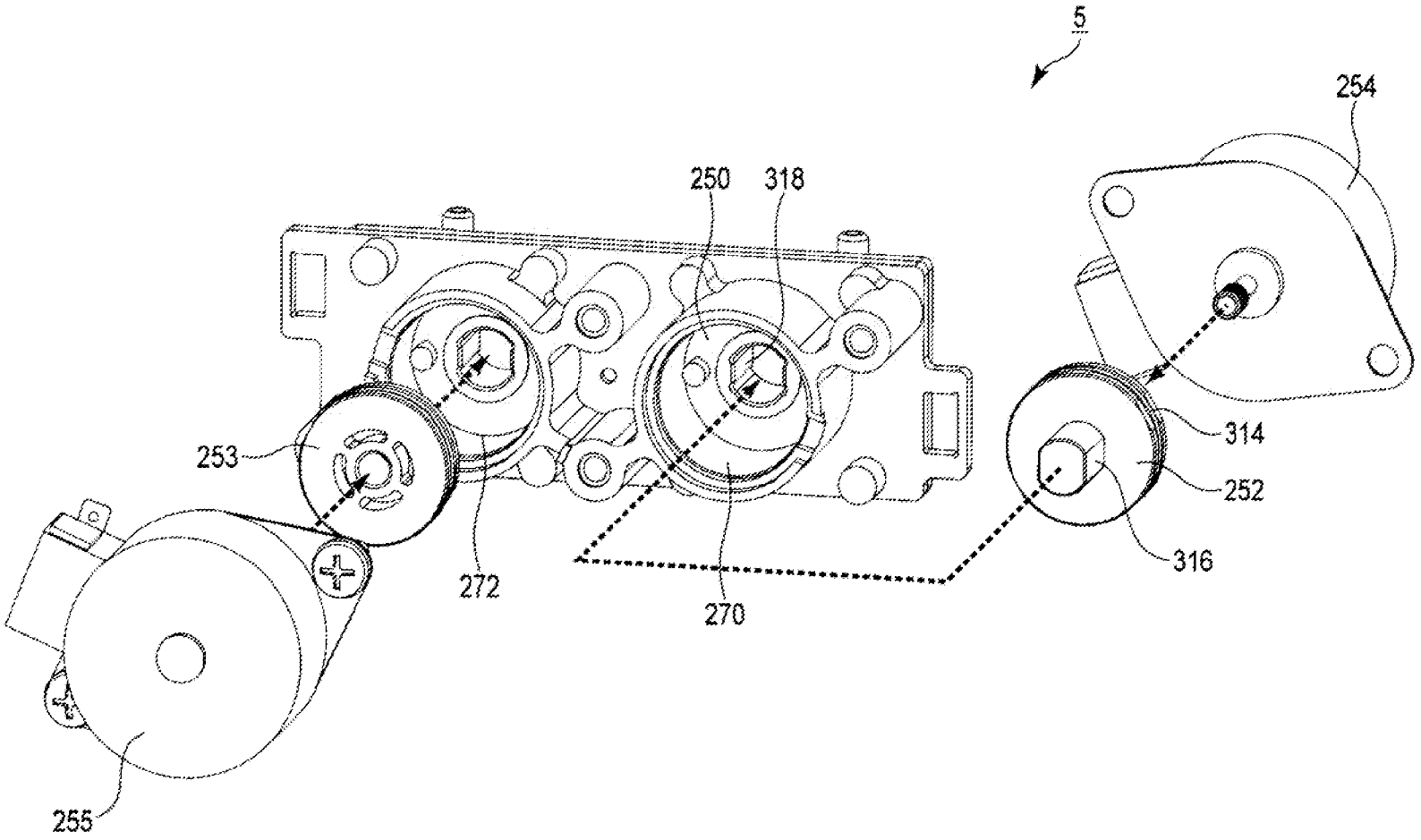
FIG. 8 is an exploded perspective view of a pressure regulator in the ink jet apparatus according to the first embodiment.
Figure 9:
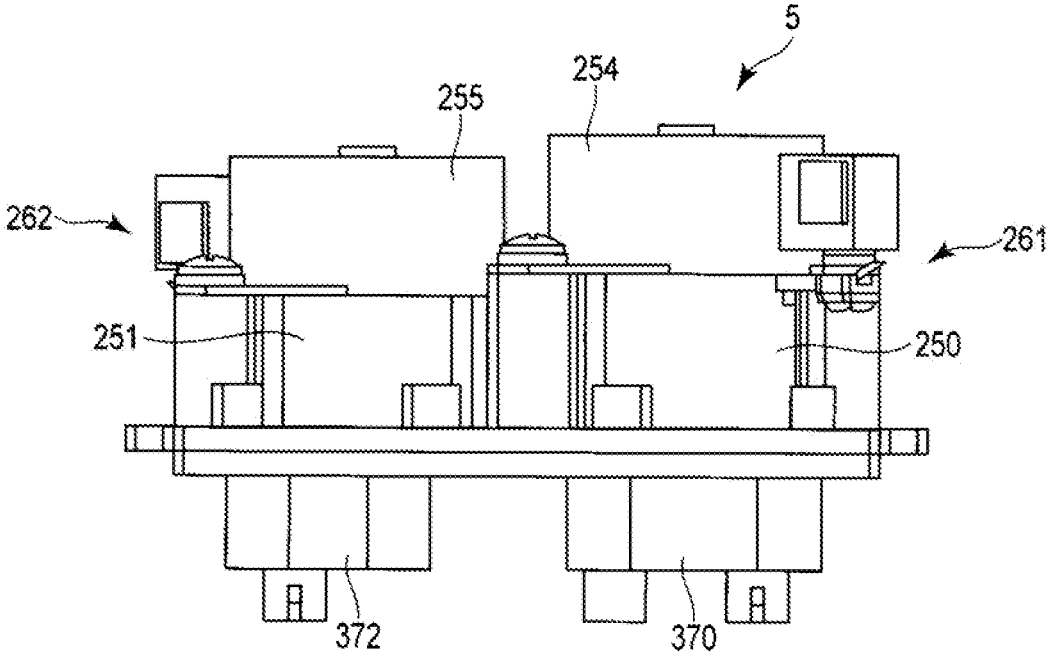
FIG. 9 is a side view of the pressure regulator according to the first embodiment.
Figure 10:
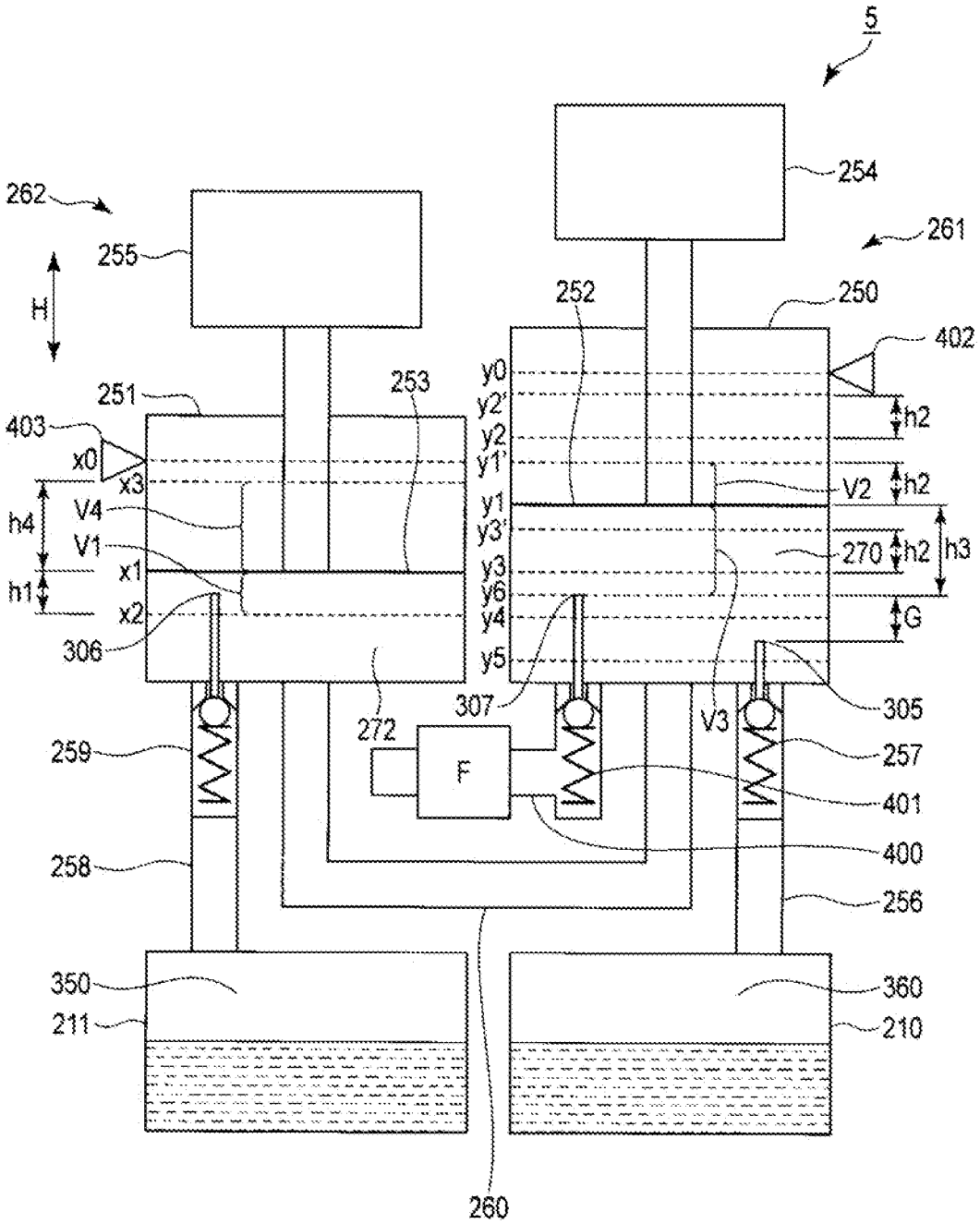
FIG. 10 is an explanatory diagram of the pressure regulator according to the first embodiment.

The pressure regulator 5 will be described based on FIG. 8 to FIG. 10. FIG. 8 is an exploded perspective view of the pressure regulator 5, FIG. 9 is a side view of the pressure regulator 5, and FIG. 10 is an explanatory diagram of the pressure regulator 5.

The pressure regulator 5 is provided on the ink casing 200 of the ink circulation device 3. The pressure regulator 5 adjusts the pressure in the ink casing 200 so as to appropriately maintain the ink pressure in the nozzles 51 of the ink jet head 2. The pressure regulator 5 includes two pressure regulating chambers 261 and 262.

The pressure regulating chamber 261 includes a cylinder 250 which forms a fourth air chamber 270, a piston 252 which is a first movable member enclosed in the cylinder 250, a pulse motor 254, which is a first volume adjusting unit that changes the volume (internal gas volume) of the cylinder 250 by, for example, advancing or retreating the piston 252 in the H directions.

The fourth air chamber 270 formed in the cylinder 250 communicates with the ink supplying chamber 210 via the communicating duct 256, and is configured to be opened or closed with respect to the atmosphere through a communicating duct 400. A second opening and closing member 257, including a spring, is attached in the communicating duct 256. The second opening and closing member 257 closes the communicating duct 256 (passage), which connects the cylinder 250 to the second air chamber 360 of the ink supplying chamber 210 by a biasing force of the spring, and opens the communicating duct 256 by the biasing force of the piston 252.

An opening and closing member (the third opening and closing member) 401, including a spring, is attached in the communicating duct 400. The opening and closing member 401 closes a communicating duct 400 (passage), which communicates with the atmosphere by a biasing force of the spring, and opens the communicating duct 400 which communicates with the atmosphere by a biasing force of the piston 252. A filter F is provided in an atmospheric air inlet of the communicating duct 400. A rubber sealant 314 is mounted on the piston 252 so as to air-tightly maintain the inside of the cylinder 250.

A screw (male portion) is fixed to a rotation shaft of the pulse motor 254, and corresponding threads for the screw (female portion) are formed in a portion into which the piston 252 is fitted. In the piston 252, a shaft 316 of the center portion is a projection having a flat portion on an outer periphery thereof. The shaft 316 is slidably fitted into a cylindrical-shape shaft hole 318, which is provided on the cylinder 250 and has a flat surface on the outer periphery thereof, and prevents the piston 252 from being rotated. The piston 252 is slid in the vertical direction in the cylinder 250 by the rotation of the pulse motor 254, and the volume (internal gas volume) of the fourth air chamber 270 surrounded by the cylinder 250 and the piston 252 is changed, thereby changing the air (or gas) pressure.

The pressure regulator 262 includes a cylinder 251 which communicates with the ink recovering chamber 211, a piston 253, which is a second movable member enclosed in the cylinder 251, and a pulse motor 255, which is a second volume adjusting unit that changes the volume of the cylinder 251 by, for example, advancing or retreating the piston 253 in the H directions.

The volume of a third air chamber 272 surrounded by the cylinder 251 and the piston 253 is changed, thereby changing the pressure. The configuration of the cylinder 251, the piston 253, and the pulse motor 255 is the same as that of the pressure regulating chamber 261.

The cylinder 251 includes a communicating duct 258 which communicates with the ink recovering chamber 211. An opening and closing member 259, including a spring, is attached in the communicating duct 258. The opening and closing member (first opening and closing member) 259 closes a communication hole which connects the cylinder 251 and the first air chamber 350 of the ink recovering chamber 211 by the biasing force of the spring, and opens the communication hole by the biasing force of the piston 253. The piston 253 is slid in the vertical direction in the cylinder 251 by the rotation of the pulse motor 255, and the volume of the third air chamber 272 surrounded by the cylinder 251 and the piston 253 is changed, thereby changing the pressure.

The first air chamber 350 communicates with a fifth air chamber 352, which is positioned above the first air chamber 350, through the passage and an opening 351 provided in the protrusion 372. The communication passage 223, which is connected to a detecting unit of a pressure sensor 204, is provided in the fifth air chamber 352. The second air chamber 360, which contains the air in contact with the liquid level a of the ink in the ink supplying chamber 210, communicates with a sixth air chamber 362 through the passage provided in the protrusion 370 and the opening 361. A communication passage 222 connected to the detecting unit of the pressure sensor 204 is provided in the sixth air chamber 362.

The pressure sensor 204 detects the pressure in each of the second air chamber 360 of the ink supplying chamber 210 and the first air chamber 350 of the ink recovering chamber 211. The pressure sensor 204 includes two pressure detection ports in one chip, communicates with the first air chamber 350 and the second air chamber 360, and measures the pressures in both of first air chambers 350 and 360. The pressure sensor 204 is connected to the control circuit board 500, and outputs air pressure of the air above the ink in the ink supplying chamber 210 and air pressure of the air above the ink in the ink recovering chamber 211 as electrical signals.

In order to constantly connect the cylinder 250 of the pressure regulating chamber 261 to the cylinder 251 of the pressure regulating chamber 262, a communication passage 260 is provided therebetween.

That is, the pressure regulator 5 includes the third air chamber 272, the opening and closing member (first opening and closing member) 259, the opening and closing member (second opening and closing member) 257, the communication passage 260, the opening and closing member (third opening and closing member) 401, the piston (first volume adjusting member) 253, and the piston (second volume adjusting member) 252.

The pressure regulator 5 appropriately maintains communicates with the meniscus 290 formed in the ink jet head 2 by moving the piston 252 and the piston 253 in the vertical direction, changing the volume of the air in the cylinders 250 and 251, switching the opening and closing member so as to open and close the flow channel, and thereby adjusting the pressure in the ink casing 200.

An operation of the pressure regulator 5 will be described with reference to FIG. 10. Reference numerals x1 and y1 are home positions of the piston 252 and the piston 253, respectively. The home position x1 is a position at which the piston 253 is not in contact with a tip end 306 of the opening and closing member 259 and the communicating duct 258 is closed. In addition, the home position y1 is a position at which the piston 252 does not press the tip end 305 of the opening and closing member 257 and the communicating duct 258 is closed.

The position x2 is a position at which the piston 253 presses the tip end 306 of the opening and closing member 259, and opens the opening and closing member 259. The position x1 is apart from the position x2 by the stroke h1, and the distance between the positions x1 and x2 is set such that the piston 253 may reach the position x2 to press the opening and closing member 259.

When the piston 252 is positioned at the home position y1, a position of the piston 252 moved upward from y1 in the H direction by the stroke h2 in such a manner that the total volume of the third air chamber 272 and the fourth air chamber 270 is maintained is set as y1'. That is, a volume V1 of the third air chamber 272 decreased by moving the piston 253 by the stroke h1 is set to be equal to a volume V2 of the fourth air chamber 270 increased by moving the piston 252 by the stroke h2. When a cross-sectional area of the cylinder 251 and the cylinder 250 are equal to each other, h1=h2 is satisfied.

A position y2' is an upper limit position that the piston 252 can reach by adjusting the pressure. When the piston 252 is at the position y2', a position, which is moved downward from y2 in the H direction by the stroke h2 such that the total volume of the third air chamber 272 and the fourth air chamber 270 is maintained, is set as y2.

A position y3' is a lower limit position that the piston 252 can reach by adjusting the pressure. When the piston 252 is at the position y3', a position, which is moved downward from y3 in the H direction by the stroke h2 such that the total volume of the third air chamber 272 and the fourth air chamber 270 is maintained, is set as y3. When the piston 252 is at the position y3, there is a distance between the piston 252 and the tip end 307 of the opening and closing member 401, so that the piston 252 is not in contact with the tip end 307. At a position y4, the piston 252 opens the opening and closing member 401, and at a position y5, the piston 252 opens the opening and closing member 257.

The procedure of opening the first air chamber 350 to the atmosphere will be described. First, when the piston 253 is at the position x2 and opens the opening and closing member 259, the opening and closing member 259 is moved to the position x1 such that the pressure variation of the pressure regulator 5 does not affect the first air chamber 350.

Next, the piston 252 is moved to the position y4, and opens the opening and closing member 401. At this time, a volume of the fourth air chamber 270 is decreased, and the pressure of each of the fourth air chamber 270 and the third air chamber 272 which communicates with the fourth air chamber 270 is increased. However, since the opening and closing member 259 is closed, the pressure in the first air chamber 350 does not change. When the piston 252 opens the opening and closing member 401, pressure of each of the fourth air chamber 270 and the third air chamber 272 becomes the atmospheric pressure.

Next, the piston 253 is moved to the position x2 to open the opening and closing member 259. At this time, the volume of the third air chamber 272 is decreased until the piston 253 contacts the tip end 306 of the opening and closing member 259. However, since the opening and closing member 401 is opened and is in the air open state, the pressure is still the atmospheric pressure. When the piston 253 is moved to the position x2 so as to contact and press the tip end 306 of the opening and closing member 259, the first air chamber 350 is in the air open state through the third air chamber 272 and the fourth air chamber 270.

The procedure of opening the second air chamber 360 to the atmosphere will be described. When the piston 253 is at the position x2 and opens the opening and closing member 259, the opening and closing member 259 is moved to the position x1 such that the pressure variation of the pressure regulator 5 does not affect the first air chamber 350.

Next, the piston 252 is moved to the position y5 so as to press and open the opening and closing member 257. At this time, until the piston 253 contacts the tip end 307 of the opening and closing member 401, the volume of the fourth air chamber 270 is decreased, and the pressure of each of the fourth air chamber 270 and the third air chamber 272 is increased. However, since the opening and closing member 259 is closed, the pressure in the first air chamber 350 does not change.

When the opening and closing member 401 is opened by being pressed by the piston 252, the pressure in each of the fourth air chamber 270 and the third air chamber 272 becomes the atmospheric pressure. At this time, when a positional relationship is set such that the tip end 305 of the opening and closing member 257 is pressed first, and then the tip end 307 of the opening and closing member 401 is pressed, the compressed air flows into the second air chamber 360, thereby causing the pressure to be changed, and thus a distance G is set so that the piston 252 contacts the tip end 307 of the opening and closing member 401 first, and then the tip end 305 of the opening and closing member 257.

When the piston 252 is moved to the position y5, and contacts and presses the tip end 305 of the opening and closing member 257, the second air chamber 360 is in the air open state through the fourth air chamber 270. Since the opening and closing member 259 is closed, the first air chamber 350 is not opened to the atmosphere.

The procedure of opening the first air chamber 350 and the second air chamber 360 to the atmosphere will be described. The piston 253 is moved to the position x2 at which the opening and closing member 259 is pressed and opened in a state where the second air chamber 360 is opened to the atmosphere. At this time, the volume of the third air chamber 272 is decreased until the piston 253 contacts the tip end 306 of the opening and closing member 259. However, since the opening and closing member 401 is opened and is in the air open state, the pressure is still the atmospheric pressure. When the piston 253 is moved to the position x2 so as to press and open the tip end 306 of the opening and closing member 259, the first air chamber 350 is in the air open state through the third air chamber 272 and the fourth air chamber 270. The second air chamber 360 is also in the air open state through the fourth air chamber 270.

Next, the procedure of returning the piston 252 from the position y4 at which the piston 252 opens the opening and closing member 401 to the home position y1 by closing the opening and closing member 401 will be described.

In the state where the first air chamber 350 is opened to the atmosphere, the position of the piston 252 is maintained at the position y4 and the piston 253 is moved to the position x1.

In the state where the second air chamber 360 is opened to the atmosphere, the piston 252 is moved to the position y4.

In the state where the first air chamber 350 and the second air chamber 360 are opened to the atmosphere, the piston 253 is moved to the position x1, and thereafter, the piston 252 is moved to y4. Then, when the piston 252 is moved to the position y6 so as to contact the tip end 307 of the opening and closing member 401, the opening and closing member 401 is closed.

When the opening and closing member 401 is closed, since the fourth air chamber 270 and the third air chamber 272 are in the airtight state, total volume of the fourth air chamber 270 and the third air chamber 272 are decreased by the volume V3 corresponding to the stroke h3 from the position y6 to the position y1, which is the home position. Accordingly, in this state, when the piston 253 is moved to the position x2 from the position x1, since the depressurized air is supplied to the first air chamber 350, there is a possibility that rapid pressure variation occurs. In order to avoid this rapid pressure variation, when the piston 252 is positioned at the position y4, that is, when the fourth air chamber 270 and the third air chamber 272 are opened to the atmosphere, the piston 253 is moved by a distance h4 from the position x1 to the position x3.

Thereafter, the piston 252 is moved from the position y4 to the position y1 through the position y6. At this time, total volume of the fourth air chamber 270 and the third air chamber 272 is decreased by the volume V3, which corresponds to the distance h3 from the position y6 to the position y1.

Then, the piston 253 is moved from the position x3 to the position x1. At this time, total volume of the fourth air chamber 270 and the third air chamber 272 is decreased by a volume V4, which corresponds to a distance h4 from the position x3 to the position x1.

When V3=V4 is satisfied, the total volume of the fourth air chamber 270 and the third air chamber 272 when the piston 253 is at the position x3 and the piston 252 is at the position y6 is the same as the total volume of the fourth air chamber 270 and the third air chamber 272 when the piston 253 is at the position x1 and the piston 252 is at the position y1.

When the piston 252 is at the position y6, that is, when the opening and closing member 401 is closed, the pressure in each of the fourth air chamber 270 and the third air chamber 272 is the atmospheric pressure, and thus the pressure in each of the fourth air chamber 270 and the third air chamber 272 is still in the atmospheric pressure even though the piston 253 is at the position x1 and the piston 252 is at the position y1.

When V3>V4 is satisfied, the total pressure of the fourth air chamber 270 and the third air chamber 272 when the piston 253 is at the position x1 and the piston 252 is at the position y1 is greater than the total pressure of the fourth air chamber 270 and the third air chamber 272 when the piston 253 is at the position x3 and the piston 252 is at the position y6. That is, the pressure is reduced by a value that corresponds to the reduction of the volume (V3−V4). By adjusting this volume, it is possible to restart the pressure adjustment after returning the pressure of the first air chamber 350 to the pressure before being opened to the atmosphere.

When V3<V4 is satisfied, the total pressure of the fourth air chamber 270 and the third air chamber 272 when the piston 253 is at the position x1 and the piston 252 is at the position y1 is smaller than the total pressure of the fourth air chamber 270 and the third air chamber 272 when the piston 253 is at the position x3 and the piston 252 is at the position y6. That is, the pressure is increased by a value corresponding to the increase of volume (V4−V3).

When the piston 252 reaches the upper limit position y2' or the lower limit position y3' which is the range in which the piston 252 is movable, the piston 252 cannot be moved further to adjust the pressure.

However, even when the piston 252 is at the position y2' or the position y3', the piston 253 may be moved from the position x2 to the position x1 in such a manner that the pressure in the first air chamber does not change. Accordingly, first, the piston 253 is moved from the position x2 to the position x1, and at the same time, the piston 252 is moved from the position y2' to the position y2, and moved from the position y3' to the position y3. In this state, the piston 252 is moved to the position y4, and opens the opening and closing member 401 to be in the air open state. Thereafter, when the piston 252 returns from the position y4 in which the piston 252 presses and opens the opening and closing member 401 to the home position y1 by closing the opening and closing member 401, it is possible to return the piston 252 to the position y1 under the pressure before performing the pressure adjustment.

FIG. 11 is a block diagram of the control circuit board 500 for controlling the operation of the inkjet apparatus 1. A power source 550, a display device 560 for displaying a state of the ink jet apparatus 1, and a key board 570 as an input device are connected to the control circuit board 500. The control circuit board 500 includes a microcomputer 510 which is a control unit that controls an operation, a memory 520 that stores a program, and an AD conversion unit 530 that receives output voltages of the pressure sensor 204 or the in-head temperature sensors 280, 281, and the heater temperature sensor 282. Further, the control circuit board 500 includes a driving circuit 540, and operates the ink jet unit 4, the carriage motor 102 which relatively moves the ink jet unit 4 with respect to the medium S, the pulse motors 254 and 255 which operates the pistons 252 and 253, the slide rail 105, the pumps 104, the ink circulation pump 201, the ink supply pump 202, and the heater 207.

Printing Operation

A printing operation of the ink jet apparatus 1 will be described. When the printing operation is performed on the ink jet apparatus 1 at a first time, the ink circulation device 3 and the ink jet head 2 are filled with ink from the ink cartridge 81. The microcomputer 510 returns the inkjet unit 4 to the standby position when the initial filling operation is instructed from the key board, and covers the nozzle plate 52 by raising the maintenance unit 310.

The microcomputer 510 controls the pressure regulator 5 and causes the pistons 252 and 253 to be positioned at the home positions x1 and y1 as illustrated in FIG. 10. The microcomputer 510 drives the ink supply pump 202 so as to feed air in the tube 82 and ink to the ink recovering chamber 211 of the ink casing 200 from the ink cartridge 81. At this time, since the flow channel resistance in the ink jet head 2 is large, the ink does flow into the ink jet head 2 and the ink supplying chamber 210 in short time period.

When the ink amount measuring sensor 205B of the ink recovering chamber 211 detects ink flow into the suction hole 212, the microcomputer 510 controls the pressure regulator 5 to start the pressure adjustment in the ink casing 200 and drives the ink circulation pump 201 for a certain period of times at the same time. The ink is fed from the ink recovering chamber 211 to the ink supplying chamber 210 through the ink circulation pump 201. When the detection result of a liquid volume the ink recovering chamber 211 and the ink supplying chamber 210 obtained by the ink amount measuring sensors 205A and 205B reaches each of the suction hole 212 and the discharge hole 213 in the ink circulation pump 201, an ink filling operation is completed. When the amount of the ink in the ink recovering chamber 211 is not sufficient, the ink supply pump 202 is driven to feed the ink to the ink recovering chamber 211 of the ink casing 200 from the ink cartridge 81.

By repeatedly performing this operation, the amount of the ink in the ink recovering chamber 211 and the ink supplying chamber 210 are appropriately set, and the initial filling operation is completed. Meanwhile, since the pressure regulator 5 is operated and the ink casing 200 is in the airtight state, even when the power is turned off, the meniscus 290 in the nozzle 51 is maintained and the ink is not discharged.

In addition, the pressure sensor 204 outputs pressure as a voltage. When the pressure sensor 204 is used for a long period of time or when the environment (a temperature) conditions are changed, a difference is generated between an actual pressure and the pressure based on the output voltage.

Thus, the output voltage value of the atmospheric pressure is stored in advance, and then the pressure (the gauge pressure) is calculated based on the difference between the output voltage value obtained at the time of detection and the output voltage value of the atmospheric pressure, thereby accurately detecting the pressure. When storing the output voltage of the atmospheric pressure, the pressure regulating chambers 261 and 262 are open to the atmospheric air. The pressure of the ink recovering chamber 211 becomes the atmospheric pressure, the output voltage value at this time is stored in the memory 520 of the control circuit board 500. When the pressure in the ink casing 200 becomes the atmospheric pressure, the pressure of the ink in the nozzle 51 of the ink jet head 2 becomes the positive pressure, and thereby the ink may leak from the nozzle 51. However, as the operation to cause the pressure in the ink casing 200 to become the atmospheric pressure is completed in a short period of time, the ink does not leak from the nozzle 51 if the ink recovering chamber 211 is adjusted to be a predetermined pressure after the output voltage value of the atmospheric pressure is stored. The operation of storing the output voltage value of the atmospheric pressure in the memory 520 is performed when the power of a device is turned on. Alternatively, the operation of storing the output voltage value of the atmospheric pressure in the memory 520 may be performed at a certain period of time intervals using a timer which is built in the device. In a case where the output voltage value is stored in the memory 520 at a certain period of time intervals, when the storing operation is required during the printing operation in an ink jet head unit 4, the printing operation needs to be stopped. In order not to stop the printing operation, the output voltage value is stored in the memory 520 after the printing operation is completed by shifting the time of storing the output voltage value of the atmospheric pressure even when the certain period of time elapsed in the timer.

When the printing is started, the microcomputer 510 controls the maintenance unit 310 to be separated from the nozzle plate 52. The microcomputer 510 controls the pressure regulator 5, and causes the piston 253 to be positioned at the position x2, and the piston 252 to be positioned at y1', so as to adjust pressure in the ink recovering chamber 211. The microcomputer 510 drives the ink circulation pump 201, and circulates the ink in an order of the ink recovering chamber 211, the ink circulation pump 201, the ink supplying chamber 210, the ink jet head 2, and the ink recovering chamber 211. In a case where the ink liquid level a which is detected by the ink amount measuring sensors 205A and 205B in the ink supplying chamber 210 and the ink recovering chamber 211 is not as high as a desired ink liquid level, the microcomputer 510 drives the ink supply pump 202 and supplies the ink from the ink cartridge 81 to the ink recovering chamber 211 until the ink liquid level becomes the desired height. The microcomputer 510 is electrically connected to the heater 207, which is bonded to the ink casing 200, and the heater 207 heats the ink until the ink reaches the desired temperature. When the ink is heated at the desired temperature, the microcomputer 510 controls the amount of energization to the heater 207 such that the ink temperature is set to be within a certain range.

Next, the microcomputer 510 controls the ink jet head 2 to discharge the ink in accordance with the image data which is printed synchronously with the scanning of the carriage 100 to the medium S. The microcomputer 510 controls the medium moving unit 7 to move the medium S by a predetermined distance via the slide rail 105, and repeats the operation of discharging the ink synchronously with the scanning of the carriage 100 to the medium S so as to form an image in the medium S. When the ink is discharged from the ink jet head 2, the amount of ink in the ink casing 200 is instantaneously reduced, the pressure in the ink recovering chamber 211 is reduced. When the pressure sensor 204 detects that the pressure in the ink recovering chamber 211 is reduced, the microcomputer 510 controls the pressure regulator 5 and causes the piston 253 to be positioned at the position x2 and the piston 252 to be positioned at the position y1' so as to adjust the pressure in the ink recovering chamber 211, and feeds the ink which is equivalent to the amount of the ink discharged by driving the ink supply pump 202, to the ink recovering chamber 211.

Here, a volume of the ink droplets discharged from the ink jet head 2 is constant, and an amount of the discharged ink droplets is calculated based on the image data, and thus, based on a product thereof, the ink consumption amount may be estimated. For this reason, the amount of ink in the ink casing 200 is immediately returned to a predetermined amount during the printing operation.

When there is no ink in the ink cartridge 81, the ink liquid level of the ink recovering chamber 211 does not become a desired height even when the ink supply pump 202 is driven for a certain period of time. When the ink liquid level of the ink recovering chamber 211 is does not reach a desired height, the display device 560 displays that the ink cartridge 81 is empty.

It is possible to maintain the satisfactory ink discharge by moving the piston 252 of the pressure regulating chamber 261 which communicates with the first air chamber 350 in such a manner that the pressure of the nozzle 51 becomes a predetermined pressure.

The inkjet apparatus 1 forms an image by reciprocating the ink jet units 4*a* to 4*b* in the direction orthogonal to the transport direction of the medium S. Meanwhile, the transport direction of the medium S is the same as the longitudinal direction in which the nozzles are arranged, and the ink jet apparatus 1 forms an image within the width corresponding to 300 nozzles on the medium S.

According to the circulation device 3 and the ink jet apparatus 1 according to the present embodiment, it is possible to maintain the satisfactory ink discharge by moving the piston 252 of the pressure regulating chamber 261 which communicates with the first air chamber 350 in such a manner that the pressure of the nozzle 51 becomes a predetermined pressure. In addition, the volume variation performed using the pistons 252 and 253 makes it possible to control the ink circulation with a few active elements such as the pulse motor and the sensor. Accordingly, it is possible to achieve the miniaturization of the ink jet apparatus 1. In addition, when the miniaturization of the circulation device and the pressure regulator are achieved, it is possible to integrally provide the circulation device and the pressure regulator on the ink jet head 2.

Second Embodiment

Figure 12:
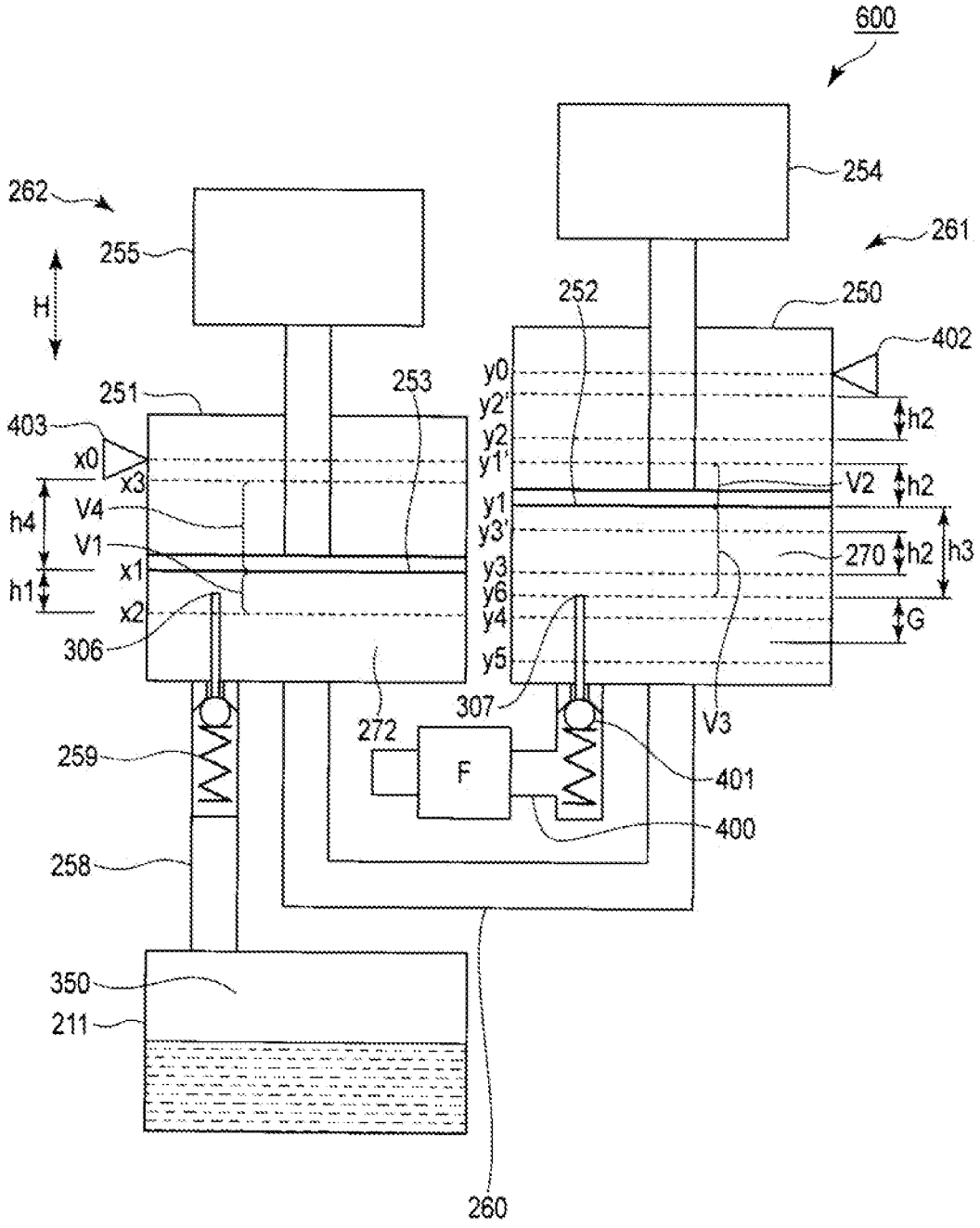
FIG. 12 is an explanatory diagram of a pressure regulator in the ink jet apparatus according to a second embodiment.

Hereinafter, a pressure regulator 600 of the ink jet apparatus 1 according to a second embodiment will be described with reference to FIG. 12. While the pressure regulating chamber 261 according to the first embodiment includes the communicating duct 256 which connects the second air chamber 360 of the fourth air chamber 270 and the ink supplying chamber 210, the pressure regulator 600 according to the second embodiment does not have components corresponding to the communicating duct 256 and the opening and closing member 257 according to the first embodiment. However, other components are the same as those of the pressure regulator 5 according to the first embodiment.

A pressure regulating chamber 261 of the pressure regulator 600 according to the second embodiment includes the cylinder 250, the piston 252 stored in the cylinder 250, and the pulse motor 254 which moves the piston 252 in the vertical direction (the H direction) so as to change the volume of the cylinder 250. The volume of the fourth air chamber 270 which is surrounded by the cylinder 250 and the piston 252 is changed, thereby changing the pressure.

The piston 252 slides in the vertical direction in the cylinder 250 in accordance with the rotation of the pulse motor 254. The cylinder 250 includes the communicating duct 400 which connects the cylinder 250 to the atmosphere. An opening and closing member (third opening and closing member) 401, including a spring, is attached in the communicating duct 400. The opening and closing member 401 closes a communication hole for communicating with the atmosphere by the biasing force of the spring and opens the communication hole by the biasing force of the piston 252. The filter F is provided in an atmospheric air intake.

The pressure regulating chamber 262 includes the cylinder 251 which communicates with the ink recovering chamber 211, the piston 253 which is stored in the cylinder 251, and the pulse motor 255 which changes the volume of the cylinder 251 by moving the piston 253 in the vertical (the H direction). The volume of a third air chamber 272 surrounded by the cylinder 251 and the piston 253 is changed, thereby changing the pressure. The configurations of the cylinder 251, the piston 253, and the pulse motor 255 are the same as those of the pressure regulating chamber 261. The cylinder 251 includes a communicating duct 258 which communicates with the ink recovering chamber 211. An opening and closing member (first opening and closing member) 259, including a spring, is attached in the communicating duct 258. The opening and closing member **259*h* closes a communication hole which connects the cylinder 251 and the first air chamber 350 in the ink recovering chamber 211 by the biasing force of the spring, and opens the communication hole by the biasing force of the piston 253**.

Further, in order to constantly connect the cylinder 250 of the pressure regulating chamber 261 to the cylinder 251 of the pressure regulating chamber 262, the communication passage 260 is provided therebetween.

The pressure in the ink casing 200 is adjusted by moving the pistons 252 and 253 in the vertical direction (the H direction) and controlling the opening and closing members 259 and 401 to be opened and closed.

In the ink jet apparatus 1 according to the second embodiment, it is possible to obtain the same effect as that in the first embodiment. In addition, it is possible to achieve the miniaturization by making the product be small.

Note that, the liquid discharge apparatus is not limited to the above-described configurations of the embodiments. For example, the liquid discharge apparatus may also discharge liquids other than the ink. The liquid discharge apparatus for discharging the liquids other than the ink may be, for example, an apparatus for discharging the liquid which includes conductive particles for forming a wiring pattern on a printed circuit board.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid discharge apparatus, comprising:

a head including a nozzle;

a tank unit having a first tank to which liquid from the head is supplied and a second tank from which liquid is supplied to the head, the second tank being connected to the first tank; and a pressure regulator including:

a first cylinder fixed and airtightly connected to an upper portion of the first tank;

a first piston movable in the first cylinder;

a first pulse motor connected to a first screw mechanism which moves the first piston linearly when the first pulse motor rotates the first screw mechanism;

a first valve configured to open and close a path between the first tank and the first cylinder according to a position of the first piston;

a second cylinder fixed and airtightly connected to a bottom portion of the first cylinder and an upper portion of the second tank;

a second piston movable in the second cylinder;

a second pulse motor connected to a second screw mechanism which moves the second piston linearly when the second pulse motor rotates the second screw mechanism;

a second valve configured to open and close a path between the second tank and the second cylinder according to a position of the second piston; and a third valve configured to open and close a path between the second cylinder and an atmosphere according to the position of the second piston.

2. The liquid discharge apparatus according to claim 1, wherein the first valve is closed when the first piston is at a first position and open when the first piston is at a second position, gas volume in the first cylinder being less when the first piston is at the second position than when at the first position.

3. The liquid discharge apparatus according to claim 2, wherein the second valve is closed when the second piston is at a third position and open when the second piston is at a fourth position, gas volume in the second cylinder being less when the second piston is at the fourth position than when at the third position.

4. The liquid discharge apparatus according to claim 3, wherein the third valve is closed when the second piston is at the third position and open when the second piston is at a fifth position, gas volume in the second cylinder being less when the second piston at the fifth position than at the third position.

5. The liquid discharge apparatus according to claim 3, wherein gas volume in the second cylinder when the second piston is at the fifth position is greater than gas volume in the second cylinder when the second piston is at the fourth position.

6. The liquid discharge apparatus according to claim 5, further comprising:

a controller configured to cause the first pulse motor to rotate the first screw mechanism to move the first piston in the first cylinder and the second pulse motor to rotate the second screw mechanism to move the second piston in the second cylinder.

7. The liquid discharge apparatus according to claim 6, wherein the controller is further configured to cause the first piston to be at the first position and the second piston to be at the fifth position, and then cause the first piston to move to the second position, such that the first tank has an atmospheric pressure.

8. The liquid discharge apparatus according to claim 6, wherein the controller is further configured to cause the first piston to be at the first position and the second piston to be at the fourth position, such that the second tank has an atmospheric pressure.

9. The liquid discharge apparatus according to claim 6, wherein the controller is further configured to cause the first piston to be at the second position and the second piston to be at the fourth position, such that the first and second tanks have an atmospheric pressure.

10. The liquid discharge apparatus according to claim 9, wherein the controller is further configured to cause, when at least one of the first tank and the second tank has the atmospheric pressure:

the first piston to be at the first position and the second piston to be at the fifth position, the first piston then to be moved to a sixth position from the first position, gas volume in the first cylinder being greater when first piston is at the sixth position than when at the first position, and the second piston then to be moved to the third position from the fifth position.

11. The liquid discharge apparatus according to claim 6, wherein the controller is further configured to cause, when a pressure in the first tank is adjusted, the first piston to be at the second position and the second piston to be at a position at which gas volume in the second cylinder is increased as compared to gas volume in the second cylinder when the second piston is at the third position.

12. The liquid discharge apparatus according to claim 1, further comprising:

a supplemental tank connected to the first tank; and a pump configured to convey liquid in the supplemental tank to the first tank.

13. A liquid discharge apparatus, comprising:

a head including a nozzle;

a tank unit having a first tank to which liquid from the head is supplied and a second tank from which liquid is supplied to the head, the second tank being connected to the first tank; and a pressure regulator including:

a first cylinder fixed and airtightly connected to an upper portion of the first tank;

a first piston movable in the first cylinder;

a first pulse motor connected to a first screw mechanism which moves the first piston linearly when the first pulse motor rotates the first screw mechanism;

a first valve configured to open and close a path between the first tank and the first cylinder according to a position of the first piston;

a second cylinder fixed and airtightly connected to a bottom portion of the first cylinder;

a second piston movable in the second cylinder;

a second pulse motor connected to a second screw mechanism which moves the second piston linearly when the second pulse motor rotates the second screw mechanism; and a second valve configured to open and close a path between the second cylinder and an atmosphere according to a position of the second piston, wherein the first valve is closed when the first piston is at a first position and open when the first piston is at a second position, gas volume in the first cylinder being less when the first piston is at the second position than when at the first position.

14. The liquid discharge apparatus according to claim 13, wherein the second valve is closed when the second piston is at a third position and open when the second piston is at a fourth position, gas volume in the second cylinder being less when the second piston is at the fourth position than when at the third position.

15. The liquid discharge apparatus according to claim 14, further comprising:

a controller configured to cause the first pulse motor to rotate the first screw mechanism to move the first piston in the first cylinder and the second pulse motor to rotate the second screw mechanism to move the second piston in the second cylinder.

16. The liquid discharge apparatus according to claim 15, wherein the controller is further configured to cause the first piston to be at the first position and the second piston to be at the fourth position, and then cause the first piston to move to the second position, such that the first tank has an atmospheric pressure.

17. The liquid discharge apparatus according to claim 16, wherein the controller is further configured to cause, when the air in the first tank has the atmospheric pressure:

the first piston to be at the first position and the second piston to be at the fourth position, the first piston to then be moved to a fifth position from the first position, gas volume in the first cylinder being greater when the first piston is at the fifth position than when at the first position, and the second piston then to be moved to the third position.

18. The liquid discharge apparatus according to claim 15, wherein the controller is further configured to cause, when a pressure in the first tank is adjusted, the first piston to be at the second position and the second piston to be at a position at which gas volume in the second cylinder is increased compared to gas volume in the second cylinder when the second piston is at the third position.

19. The liquid discharge apparatus according to claim 13, further comprising:

a supplemental tank connected to the first tank; and a pump configured to convey liquid in the supplemental tank to the first tank.

20. The liquid discharge apparatus according to claim 1, wherein the second valve includes a first member that extends into the second cylinder, the path between the second tank and the second cylinder being opened when the second piston pushes an extended end of the first member, the third valve includes a second member that extends into the second cylinder, the path between the second cylinder and the atmosphere being opened when the second piston pushes an extended end of the second member, and a location of the extended end of the first member along a moving direction of the second piston when the second piston is apart therefrom is different from a location of the extended end of the second member along the moving direction when the second piston is apart therefrom.

* * * * *